US006182492B1

(12) United States Patent
Raffin et al.

(10) Patent No.: US 6,182,492 B1
(45) Date of Patent: Feb. 6, 2001

(54) HEMMING MACHINE

(75) Inventors: Louis Raffin, Windsor; Dominique R. M. Baulier, Tecumseh, both of (CA)

(73) Assignee: E.R. ST. Denis Inc., Oldcastle (CA)

( * ) Notice: Under 35 U.S.C. 154(b), the term of this patent shall be extended for 0 days.

(21) Appl. No.: 09/430,967

(22) Filed: Nov. 1, 1999

(51) Int. Cl.[7] ..... B21D 5/01

(52) U.S. Cl. ..... 72/454; 72/448; 72/323; 72/381; 72/384; 29/243.58; 100/99; 83/631

(58) Field of Search ..... 72/323, 381, 384, 72/448, 454; 29/243.58; 100/99; 83/631

(56) References Cited

U.S. PATENT DOCUMENTS

| | | | | |
|---|---|---|---|---|
| 5,454,261 | | 10/1995 | Campian | 72/384 |
| 5,488,880 | * | 2/1996 | Sartorio | 72/454 |
| 5,669,296 | * | 9/1997 | Newton | 72/454 |

* cited by examiner

*Primary Examiner*—David Jones
(74) *Attorney, Agent, or Firm*—Gifford, Krass, Groh, Sprinkle, Anderson & Citkowski, P.C.

(57) ABSTRACT

A hemming machine of the type having a base, a nest for supporting a sheet metal part to be hemmed, and at least one die is disclosed in which the nest supporting the part to be hemmed is vertically displaced against the dies in order to form the hem. The improvement includes at least three elongated and external shafts wherein each shaft has one end rotatably mounted to the base so that the shafts are spaced apart and parallel with each other. A nut threadably engages each shaft, and these nuts are swivelly secured to the nest which permits a small amount of angular and radial deflection of the nut and shafts during movement of the nest from its lower to its upper position. An electric servo-motor is associated with each threaded shaft to rotatably drive the shafts substantially in unison with each other during the travel approach phase, and then allows in final a slight disynchronization of them, to insure an equalization of the hemming effort applied on each edge of the part, in both pre-hemming and hemming operations.

13 Claims, 3 Drawing Sheets

20
24
28
22
26
30
16
19
18
19
34
14
36
37
37
12
40
10

FIG-4
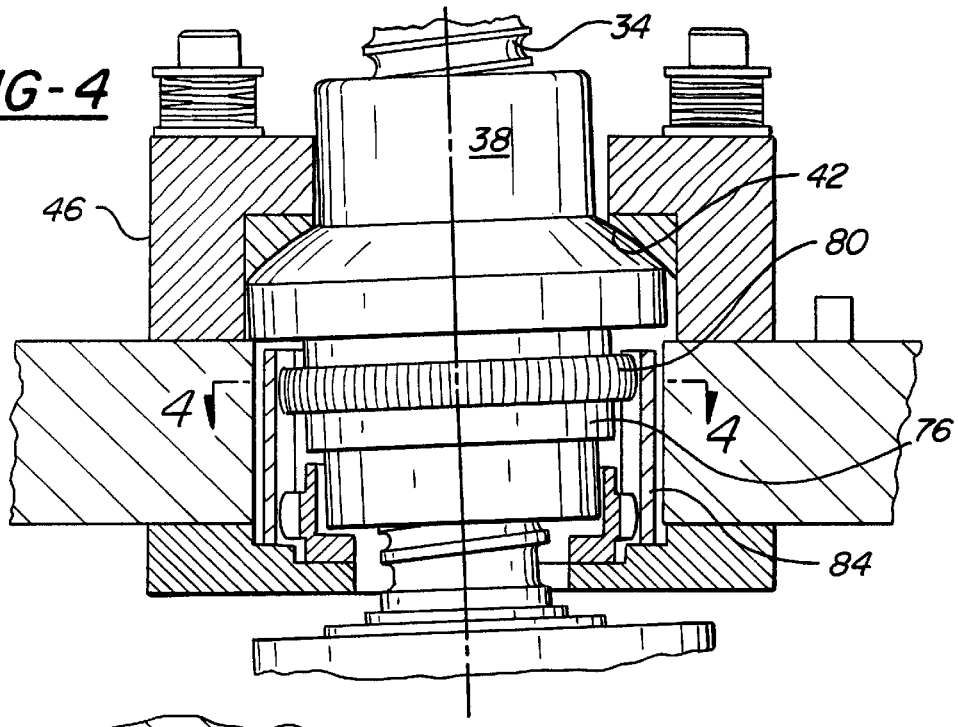
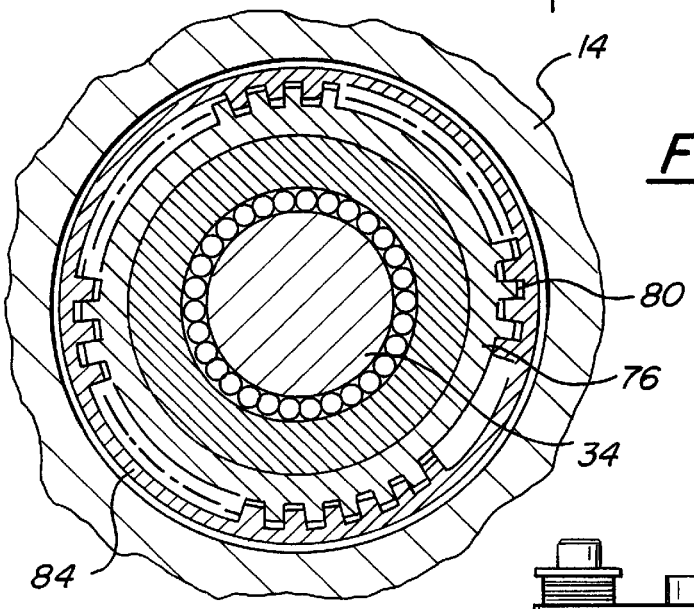
FIG-3
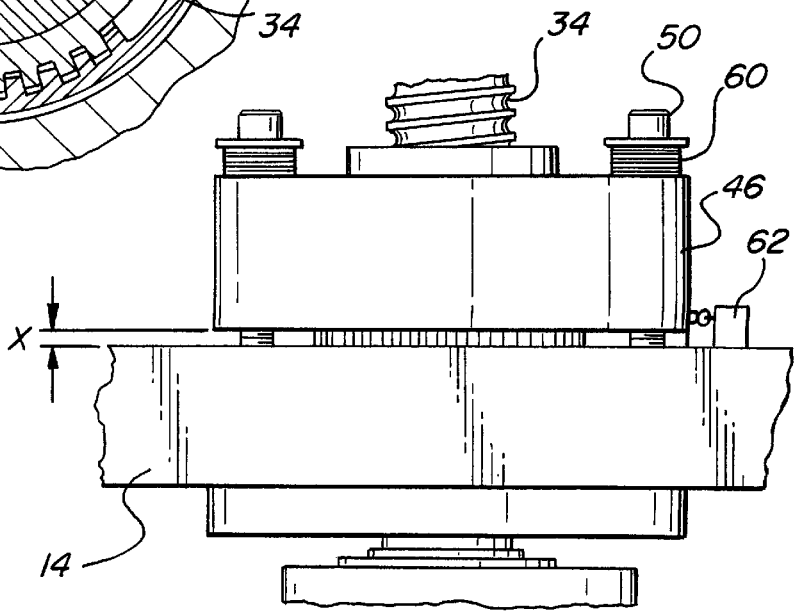
FIG-5

HEMMING MACHINE

BACKGROUND OF THE INVENTION

I. Field of the Invention

The present invention relates to hemming machines and, more particularly, to a sheet metal hemming machine utilizing a vertically movable nest supporting the sheet metal part to be hemmed to press against stationary dies which are moved into and out of an operating position.

II. Description of the Prior Art

Typically sheet metal hemming devices utilize hydraulic cylinders for imparting vertical movement to the impacting punch or nest. The vertical movement provided by the cylinders is often erratic which slows down the operation of the hemming process and otherwise causes inaccuracies. This is particularly critical where multiple actuating hydraulic cylinders are employed, even if in final, this compliance allows a perfect balancing of the hemming effort on each edge of the part.

A major disadvantage of the previously known use of hydraulic cylinders for hemming machines is the inevitable leakage of the hydraulic fluid and the resulting mess created by such leakage.

There have, however, been previously known hemming machines which utilize electric servo-motors in order to vertically displace the nest to perform the hemming operation. These previously known electric motor actuated hemming machines, however, have required a complete synchronization between the rotation of the actuating shafts in order to achieve the vertical displacement of the nest. In practice, however, such absolute synchronization between the rotatable shafts cannot be achieved in every situation, and does not allow a perfect balancing of the hemming effort applied on each edge of the part, in both pre-hemming and hemming positions. Furthermore, any lack of synchronization between the electric motor actuated shafts may result in seizure and even destruction of the hemming machine.

SUMMARY OF THE PRESENT INVENTION

The present invention provides a hemming machine which utilizes electric servo-motor actuated shafts for vertically displacing the nest which overcomes all of the above-mentioned disadvantages of the previously known devices.

In brief, the hemming machine of the present invention includes a base and a nest for supporting a sheet metal part to be hemmed. At least one die is mounted to the base and is movable between an extended position in which the die registers with the nest, and a retracted position in which the die is retracted from the nest thus permitting the completed hemmed part to be removed from the nest as well as a new sheet metal part to be placed on and supported by the nest.

At least three and preferably four elongated and externally threaded shafts each have their lower ends rotatably mounted to the base so that the shafts are spaced apart and parallel to each other. An electric servo-motor is operatively coupled with each shaft so that, upon actuation of the master servomotor, the other slave servo-motors drive the shaft substantially, although as a practical matter not entirely, in synchronism with the master servo-motor.

Means are mounted to the nest for threadably receiving the second or upper end of each shaft and this threadable receiving means is fixed against rotation to the nest. Consequently, rotation of the threaded shafts vertically displace the nest due to their coaction with the threadable receiving means.

In the preferred embodiment of the invention, the threadable receiving means comprises a nut which is threadably engaged with the shaft. A first externally splined annulus is coaxially disposed around the nut and this first annulus is secured against movement to the nest.

A second externally splined annulus is then coaxially disposed around and secured to the nut so that the second annulus is axially spaced from and coaxial with the first annulus. An internally splined tube is then disposed around the first and second annuli so that the internal splines on the tube intermesh with the external splines on the annuli. Consequently, the annuli, together with the internally splined tube, preclude rotation of the nut relative to the nest so that rotation of the shaft axially displaces the nut together with the nest.

In order to permit angular or slight radial displacement of the shafts relative to each other as would occur unless the shafts are absolutely synchronized for rotation to each other, the nut is swivelly mounted to the nest. In the preferred embodiment of the invention, this swivel mounting means comprises a thrust bushing having a semispherical surface and a bushing retainer which secures the bushing against pure vertical movement to the nest. A complementary semispherical surface formed on the nut abuts against the semispherical surface on the bushing to thereby permit limited swiveling movement of the nut relative to the nest. Such limited swivel capability of the nut relative to the nest is sufficient to compensate for limited non-synchronism of the rotation of the threaded shafts, and let the servo-motor controller react against any incidental situation.

In the preferred embodiment of the invention, the bearing retainer is secured to the nest by compression washers, preferably Belleville washers, which will compress whenever the axial force exerted on the compression washer exceeds a predetermined minimum amount. Thus, in the event that a machine jam or other failure results in an excessive axial force exerted between the nut and bearing retainer relative to the nest, the compression washers will compress slightly thus axially displacing the bushing retainer relative to the nest. Any such displacement of the bearing retainer relative to the nest is detected by a sensor which can then be used to terminate the operation of the hemming machine thereby protecting the hemming machine against destructive forces which might otherwise occur (kinetic energy generated by motor inertia).

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 3 is a sectional view taken substantially along line 4–4 in FIG. 4;

FIG. 4 is a view similar to FIG. 2 and illustrating the operation of the preferred embodiment of the present invention; and FIG. 5 is a fragmentary side view illustrating the operation of the preferred embodiment of the invention in an overload condition.

DETAILED DESCRIPTION OF A PREFERRED EMBODIMENT OF THE PRESENT INVENTION

Figure 1:
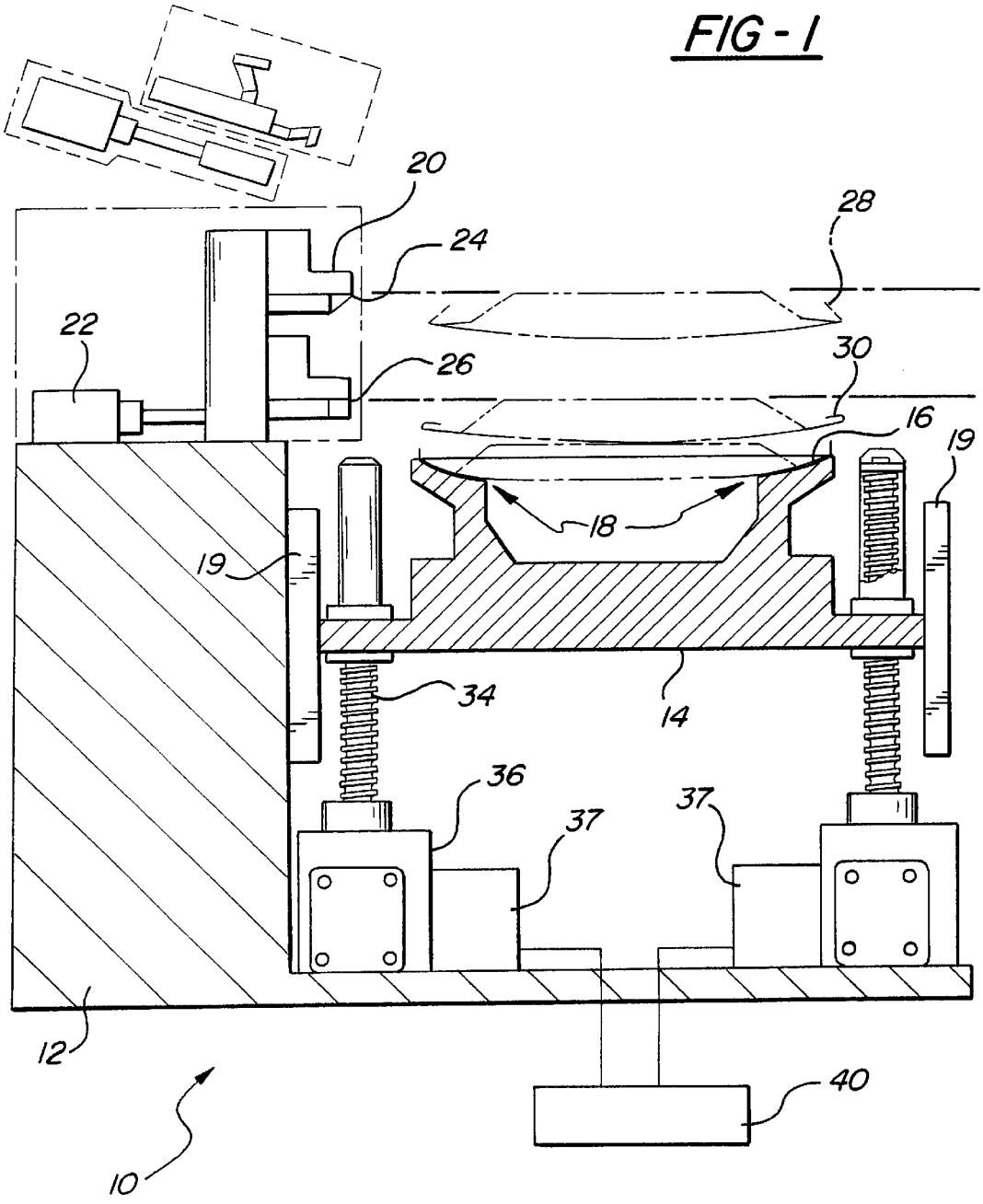
FIG. 1 is a diagrammatic side view illustrating a preferred embodiment of the present invention.

With reference first to FIG. 1, a diagrammatic view of a preferred embodiment of the hemming machine 10 of the present invention is there shown. The hemming machine 10 includes a base 12 and a nest 14. The nest 14 is adapted to receive and support a sheet metal part 16 to be hemmed at its peripheral surface 18. The hemming machine 10, in the conventional fashion, includes at least one and preferably four dies 20 which are laterally movable by an actuator 22 between a retracted position, illustrated in solid line in FIG. 1, and an extended position, illustrated in phantom line in FIG. 1. In its extended position, the die 20 registers with the part to be hemmed while, conversely, in its retracted position, the die 20 is moved laterally out of registry with the nest 14 in order to permit the finished hemmed part 16 to be removed from the nest 14 as well as a new sheet metal part 16 to be hemmed to be positioned on the nest surface 18.

Conventionally, the die set 20 includes two dies 24 and 26. The die 24 is shaped to form an initial bend of approximately 45 degrees, as shown at 28, as the nest 14 is vertically displaced with its supported sheet metal part 16 against the die 24. Conversely, the die 26 is shaped to complete the hem on the sheet metal part 16, i.e. to substantially flatly abut the edges of the sheet metal part together as shown at 30.

During a typical operation of the nest 14, after the sheet metal part 16 to be hemmed is positioned on the support surface 18 of the nest 14, the nest 14 is vertically displaced such that the sheet metal part 16 is positioned in between the dies 24 and 26. The die set 20 is then moved to its extended position so that the die 24 registers with the outer edge of the sheet metal part 16 to be hemmed. Further vertical extension of the nest 14 then compresses the sheet metal part to be hemmed 16 against the die 24 thus performing the 45 degree bend as illustrated at 28.

Following the initial bend, the die set 20 is moved to its retracted position by the actuator 22. The nest 14 is then lowered so that the part 16 to be hemmed is positioned under the second die 26. The die set 20 is then moved to its extended position so that the die 26 registers with the part 16. The nest 14 is then again vertically displaced upwardly against the die 26 thus completing the hem 30. Thereafter, the die set 20 is moved to its retracted position and the finished sheet metal part 16 is removed from the nest support surface 18. A new sheet metal part to be hemmed is then positioned on the nest support surface 18 and the above process is repeated.

The foregoing description of the operation of the hemming machine 10 is set forth for completeness only. The operation of the hemming machine 10 thus far described is conventional in nature.

Still referring to FIG. 1, in order to vertically displace the nest 14 and thus perfom the hemming operation, the hemming machine 10 includes at least three and preferably four elongated and externally threaded shafts 34 (only two shafts are illustrated in FIG. 1). A lower end of each shaft 34 is rotatably mounted within a gear box 36 so that the shafts 34 are spaced apart and parallel to each other. Typically, the nest 14 is generally polygonal in shape and one shaft 34 is aligned with each comer of the nest 14. Furthermore, lateral guides 19 engage the sides of the nest 14 to center the rest 14 with respect to the dies 24 and 26.

An electric servo-motor 37 (illustrated only diagrammatically) is associated with each gear box 36 so that actuation of each electric motor 37 rotatably drives its associated threaded shaft 34. A servo-motor control system 40 is operatively coupled with the motors 37 so that operation of any slave servo-motors 37 can substantially, but as a practical matter not systematically, synchronous with the master servo-motor With reference now to FIG. 2, the shaft 34 is threadably secured to the nest 14 by a swivel mounting means 36. The swivel mounting means 36 comprises a nut 38 which threadably engages the shaft 34. The nut 38 includes an upper semispherical surface 40 around its outer periphery which abuts against a complementary semispherical surface 42 on a thrust bushing 44. An annular bushing retainer 46 extends circumferentially around the nut 38 so that a portion 48 of the bushing retainer 46 sandwiches the thrust bushing 44 and outer periphery of the nut 38 between the bushing retainer portion 48 and nest 14.

A plurality of elongated threaded members or bolts 50 extend through registering bores 52 and 54 in the bushing retainer 46 and nest, respectively, and threadably engage an internally threaded bore 56 of a retainer ring 58. Preferably a number of compressible washers 60, such as Belleville washers, are sandwiched in between the upper end of the threaded fastener 50 and the bushing retainer 48.

During normal operation, the bolts 50 secure the bushing retainer 46 to the nest 14 against axial displacement relative to the threaded shaft 34. In doing so, the bushing retainer 46 together with the thrust bushing 44 retains the nut 38 against axial movement relative to the nest 14. However, as best shown in FIG. 5, in the event that the axial force exerted by the shaft 34 on the nut 38 exceeds a predetermined amount, indicative of a machine failure or jam up, the compressible washers 60 compress together thus allowing limited axial displacement "x" of the bushing retainer 46 relative to the nest 14. This limited axial displacement is detected, as well as a weakage in the thrust bushing 44, by a conventional sensor 62 activated by a connecting rod 63, which generates an output signal to the motor control 40 (FIG. 1) to terminate operation of the motors 37 thereby preventing continued operation of the motors 37, and the possible damage or destruction of the hemming machine 10.

Figure 2:
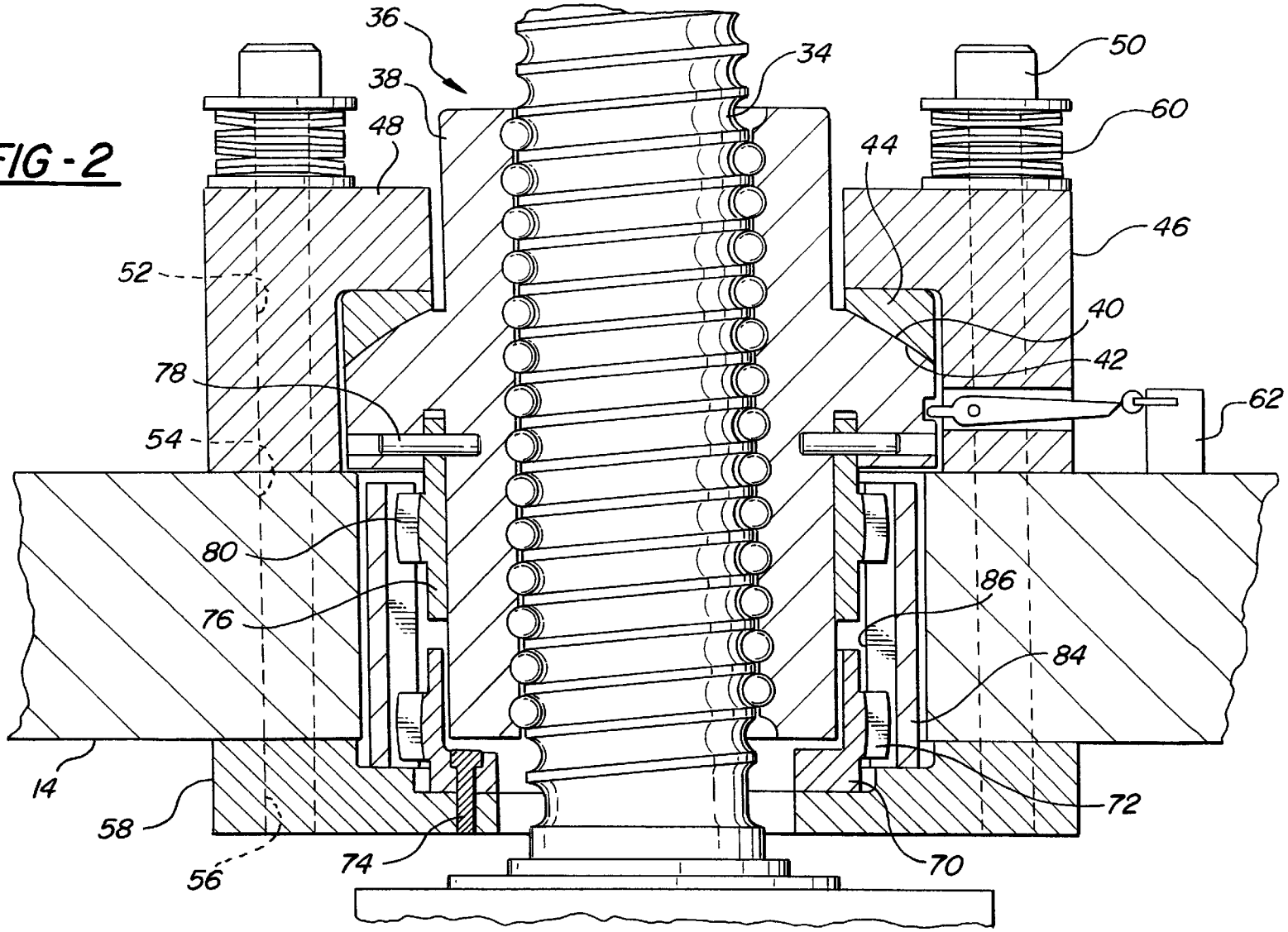
FIG. 2 is a fragmentary longitudinal sectional view illustrating a portion of the preferred embodiment of the present invention.

Still referring to FIG. 2, in order to lock the nut 38 to the nest 14 against rotation, a first annulus 70 (FIG. 2) having a plurality of circumferentially spaced and outwardly extending crowned splines 72 is coaxially disposed around the shaft 34. This annulus 70, further, is secured against rotation to the ring retainer 58, and thus to the nest 14, by fasteners 74.

A second annulus 76 is also coaxially disposed around the shaft 34 but axially spaced from the first annulus 70. The second annulus 76 is secured against rotation to the nut 38 by any conventional means, such as transverse pins 78. The second annulus 76 also includes circumferentially spaced and outwardly extending crowned splines 80. Furthermore, for a reason to be subsequently described in greater detail, the outer periphery of the splines 72 on the first annulus 70, as well as the splines 80 on the second annulus 76, are longitudinally arcuately curved along their length and crowned.

As shown in FIGS. 2–4, an internally splined tube 84 is then coaxially disposed around both annuli 70 and 76 so that the internal splines 86 of the tube 84 mesh with the crowned splines 72 and 80 on the first annulus 70 and second annulus 76 respectively. Since the first annulus 70 is rigidly locked against rotation to the nest 14 by the fasteners 74, the tube 34 and second annulus 76.

With reference now to FIGS. 2 and 4, the coupling provided by the semispherical surface 42 on the bushing 44 and its cooperation with the complementary spherical surface 40 on the nut 38 allows the nut 38 to swivel relative to the nest from the axially aligned position shown in FIG. 2 and to the slightly misaligned position shown in FIG. 4. In doing so, the second annulus 76 will swivel or slightly pivot relative to the first annulus 70 and the longitudinally extending arcuate outer surface on the splines 80 facilitate this slight pivotal action relative to the internally splined tube 84. Furthermore, the swivel or pivotal action between the annuli 70 and 76 is achieved while still locking the nut 38 against rotation relative to the nest 14.

In practice, the actuation of the electric motors 37 (FIG. 1) by the motor control 40 will substantially synchronously rotatably drive the shafts 34 in unison with each other. However, some asynchronism of the shafts 34 with respect to each other will always occur in an electric motor driven system. The swivel connection 36 between the nuts 38 and the nest 14 compensates for such slight asynchronism between the rotation of the shafts 34 thus allowing vertical movement of the nest 14 without jamming or the imposition of other potentially destructive machine forces.

However, in the event of a machine jam or other malfunction, the compressible washers 60 allow limited axial displacement of the bushing retainer 46 relative to the nest 14 as shown in FIG. 5. Such axial displacement is detected by the sensor 62 which generates an output signal to the motor control 40 to terminate operation of the motors 38 and prevent damage to the hemming machine 10.

From the foregoing, it can be seen that the present invention provides a simple and yet highly effective electric motor driven hemming machine which overcomes the above-mentioned disadvantages of the previously known devices. Having described my invention, however, many modifications thereto will become apparent to those skilled in the art to which it pertains without deviation from the spirit of the invention as defined by the scope of the appended claims.

I claim:

1. In a hemming machine of the type having a base, a nest for supporting a sheet metal part to be hemmed, at least one die, and means for moving at least one die into and out of registry with said nest, an improved actuator for vertically moving said nest relative to said base toward and away from said die comprising:

at least three elongated and externally threaded shafts, each shaft having one end rotatably mounted to said base so that said shafts are spaced apart and parallel with each other, means mounted to said nest for threadably receiving a second end of each shaft, said threadably receiving means being fixed against rotation to said nest, servo-motor means associated with each shaft for rotatably driving said shafts substantially in synchronism with each other, wherein said threadably receiving means further comprises a nut which threadably engages said shaft, a first externally splined annulus coaxially disposed around said nut, said first annulus secured to the nest, a second externally splined annulus coaxially disposed around and secured to said nut so that said second annulus is axially spaced from said first annulus, an internally splined tube disposed around first and second annuli so that said internal spines on said tube intermesh with said external splines on said annuli, and means for swivelly mounting said nut to the nest.

2. The invention as defined in claim 1 wherein said swivel mounting means comprises a bushing having a semispherical surface, a bushing retainer and means for securing said bushing retainer to the nest for retaining said bushing to the nest, and wherein said nut includes a semispherical surface complementary to and in abutment with said bushing semispherical surface.

3. The invention as defined in claim 2 wherein said means for securing said bushing retainer to the nest includes means for permitting limited axial displacement of said bushing retainer relative to the nest when an axial force exerted by said screw shaft on said nut exceeds a predetermined amount.

4. The invention as defined in claim 3 wherein said means for permitting limited axial displacement comprises a plurality of threaded members, each extending through registering bores in the nest and said nut retainer, a plurality of nuts, one nut engaging each threaded member, and at lest one compressible washer sandwiched between each nut and the nest.

5. The invention as defined in claim 4 wherein each compressible washer is a Belleville washer.

6. The invention as defined in claim 4 and comprising means for detecting axial movement between said bushing retainer and the nest.

7. The invention as defined in claim 6 wherein the means used to detect an overload on a shaft may also detect an underload when the nut becomes under tension.

8. The invention as defined in claim 6 wherein at the last stage of both the pre-hemming and the hemming operations, the pure synchronization of the servo-motor may be broken for a while and under a limited stroke to allow each shaft to develop a presetted pushing effort to insure an equalization of the hemming effort applied on each edge of the part, even in case of slight initial mismatching between die and nest.

9. The invention as defined in claim 7 wherein at the last stage of both the pre-hemming and the hemming operations, the pure synchronization of the servo-motor may be broken for a while and under a limited stroke to allow each shaft to develop a presetted pushing effort to insure an equalization of the hemming effort applied on each edge of the part, even in case of slight initial mismatching between die and nest.

10. The invention as defined in claim 1 wherein each externally threaded shaft is a ball screw.

11. The invention as defined in claim 10 wherein at the last stage of both the pre-hemming and the hemming operations, the pure synchronization of the servo-motor may be broken for a while and under a limited stroke to allow each shaft to develop a presetted pushing effort to insure an equalization of the hemming effort applied on each edge of the part, even in case of slight initial mismatching between die and nest.

12. The invention as defined in claim 1 wherein each spline on said annuli includes an arcuately curved and axially extending outer crowned surface.

13. The invention as defined in claim 12 wherein at the last stage of both the pre-hemming and the hemming operations, the pure synchronization of the servo-motor may be broken for a while and under a limited stroke to allow each shaft to develop a presetted pushing effort to insure an equalization of the hemming effort applied on each edge of the part, even in case of slight initial mismatching between die and nest.

* * * * *